US005551999A

United States Patent [19]

Gostic

[11] Patent Number: 5,551,999

[45] Date of Patent: Sep. 3, 1996

[54] CYCLIC RECOVERY HEAT TREATMENT

[75] Inventor: William J. Gostic, Jupiter, Fla.

[73] Assignee: United Technologies Corporation, Hartford, Conn.

[21] Appl. No.: 604,255

[22] Filed: Apr. 23, 1984

[51] Int. Cl.[6] ..... C21D 1/78; C22F 1/10

[52] U.S. Cl. ..... 148/562; 148/675

[58] Field of Search ..... 148/13, 13.1, 428, 148/162, 562, 675

[56] References Cited

U.S. PATENT DOCUMENTS

| | | | |
|---|---|---|---|
| 3,272,666 | 9/1966 | Symonds | 148/13 |
| 3,415,641 | 12/1968 | Ross | 148/162 X |
| 3,494,709 | 2/1970 | Piearcey | 416/232 |
| 3,677,830 | 7/1972 | Cox et al. | 148/428 X |
| 3,741,821 | 6/1973 | Athey et al. | 148/162 X |
| 3,753,790 | 8/1973 | Walker et al. | 148/13 X |
| 4,253,885 | 3/1981 | Maurer et al. | 148/13.1 |
| 4,305,761 | 12/1981 | Bruch et al. | 148/13.1 X |

FOREIGN PATENT DOCUMENTS

| | | | |
|---|---|---|---|
| 1417474 | 12/1975 | United Kingdom | 148/162 |

*Primary Examiner*—Richard D. Lovering
*Attorney, Agent, or Firm*—Charles E. Sohl

[57] ABSTRACT

A cyclic heat treatment for eliminating the tendency of moderately deformed superalloys to recrystallize is described. The superalloys are subjected to a temperature cycle including a period at a high temperature and a period at a low temperature. The resultant heat treated articles are resistant to recrystallization at temperatures above the gamma prime solvus temperature.

13 Claims, 2 Drawing Sheets

CYCLIC RECOVERY HEAT TREATMENT

The Government has rights in this invention pursuant to Contract No. F33615-80-C-5018 awarded by the Department of the Air Force.

TECHNICAL FIELD

This invention relates to a heat treatment which can be applied to moderately deformed superalloy articles to reduce their tendency to recrystallize. This heat treatment is particularly applicable to single crystal superalloy articles.

BACKGROUND ART

Superalloys are metallic materials having useful properties at temperatures on the order of 1000° F. and above and find application in gas turbine engines. One large class of superalloys are nickel base alloys which are strengthened by the gamma prime phase (based on $Ni_3Al$) in particulate form. Such superalloys generally display a reduction in the gamma prime content with increasing temperature and at a particular temperature (the gamma prime solvus temperature), the gamma prime phase is completely dissolved into solid solution and no gamma prime particles are present. While some superalloys melt before the gamma prime phase is dissolved, many alloys of commercial interest exhibit a gamma prime solvus temperature.

Initially superalloys were employed in equiaxed polycrystalline form. Each article was composed of many individual (essentially equiaxed) crystals which are randomly oriented with respect to each other. Advances in the understanding of the mechanical behavior of materials led to the development of columnar grain and single crystal technology. Single crystals are now used in some gas turbine engines particularly as blades since it has been found that at elevated temperatures the properties of single crystals are substantially superior to those of the prior art polycrystalline material.

It is also known that although the gamma prime phase when present effectively inhibits recrystallization, if a superalloy is deformed more than about 2% and then heated to a temperature above the gamma prime solvus temperature, the material will recrystallize and new grains will form in the area which has been deformed (the actual behavior is more complex than this, depending in part upon the deformation temperature). Formation of such new grains is undesirable in a single crystal since the grain boundaries which separate the new grains from the original single crystals will be areas of weakness and will reduce the effectiveness of the article in service. There are also situations in polycrystalline materials, where a particular condition of grain size and/or preferred orientation must be maintained, where recrystallization will adversely affect the material properties and should be avoided.

It is known to form a complex superalloy article by diffusion bonding two or more components together. It is also known that single crystal components can be bonded in such a way that the boundary between the single crystals is innocuous, or even nonexistent if the crystals are properly oriented—see U.S. Pat. No. 4,033,041. However, in diffusion bonding such articles localized deformations in excess of 2% can occur resulting in recrystallization during subsequent heat treatment.

DISCLOSURE OF INVENTION

This invention is a heat treatment for nickel base superalloy articles which can eliminate or reduce the tendency of such articles to recrystallize after moderate degrees of deformation. In particular this heat treatment is applicable to single crystal articles and can prevent recrystallization and the formation of new grains in such articles. However, the treatment will also find applications in situations where, in polycrystalline material, recrystallization is to be avoided.

If a precipitation strengthened superalloy material has been deformed, thereby introducing dislocations, the increased dislocation density may induce recrystallization.

The essence of the invention heat treatment is the repetitive cycling of the material between two temperatures, one a low temperature at which most of the gamma prime phase is precipitated, and the other a higher temperature at which most of the gamma prime phase is taken into solution. Sufficient precipitated gamma prime is retained at all times to prevent recrystallization. During the cycling a recovery process occurs so that the concentration and morphology of the dislocations resulting from prior deformation are modified to a stable low energy configuration so that recrystallization will not occur upon subsequent exposure to temperatures above the gamma prime solvus.

Accordingly, it is an object of this invention to provide a heat treatment which can eliminate the tendency of moderately deformed superalloy materials, particularly single crystals, to recrystallize when subsequently heated above their gamma prime solvus temperature.

Other features and advantages will be apparent from the specification and claims and from the accompanying drawings which illustrate an embodiment of the invention.

BEST MODE FOR CARRYING OUT THE INVENTION

Figure 1:
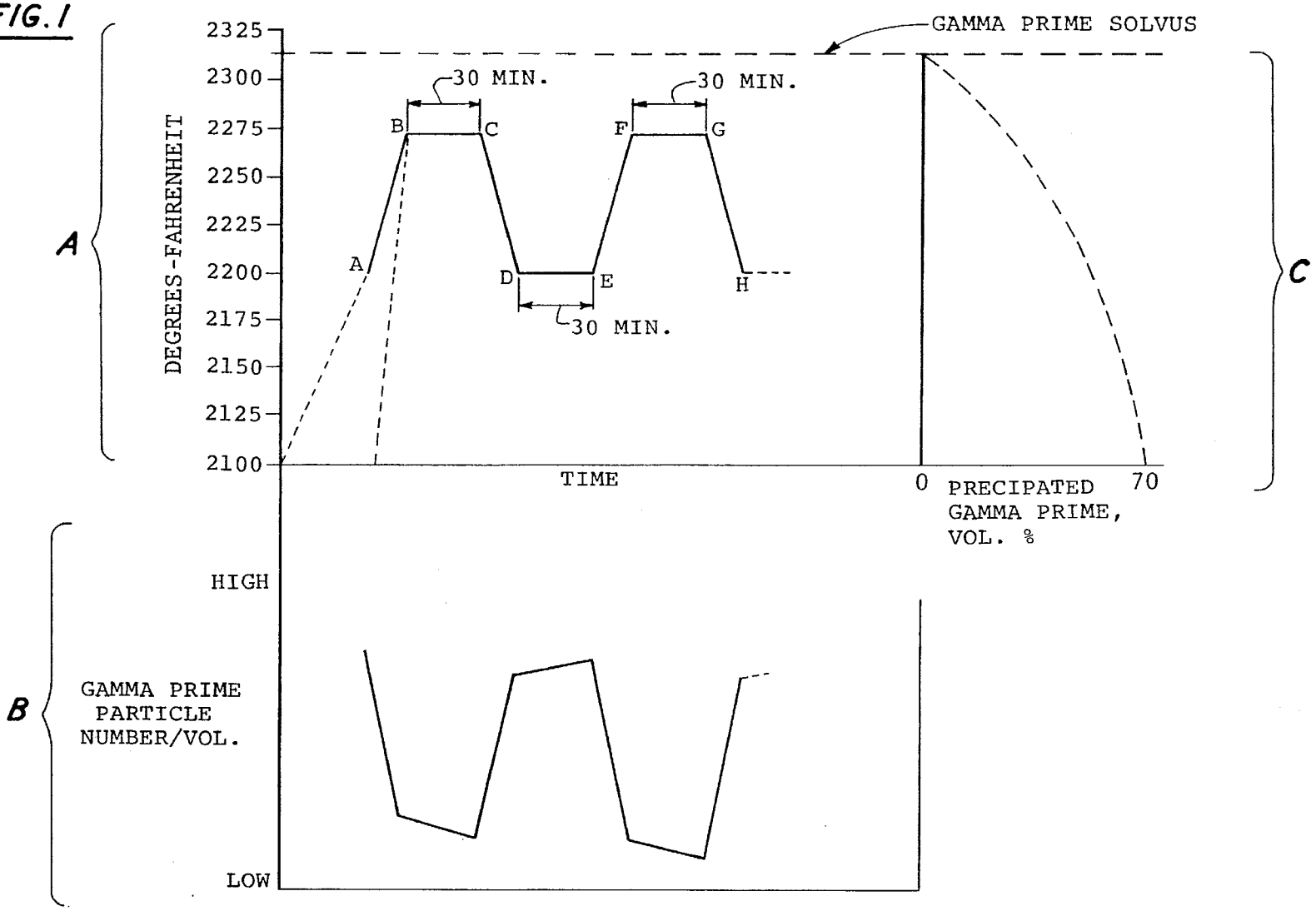
FIG. 1A is a schematic plot of a time-temperature cycle of the present invention.
FIG. 1B is a schematic plot showing the variation in equilibrium gamma prime content of a superalloy as a function of temperature.
FIG. 1C is a schematic plot showing the variation in average gamma prime particle concentration during the FIG. 1A cycle.

FIG. 1 shows an exemplary-embodiment of the invention heat treatment cycle as it can be applied to a single crystal article having a nominal composition of 8.9% Cr, 6.8% Al, 9.7% W, 3% Ta, 1% Mo, 0.15% Hf, 0.1% Y, balance Ni. Such a material will have gamma prime precipitate particles present in an amount of about 70 volume percent at low temperature and will have a gamma prime solvus temperature of about 2320° F.

FIG. 1A shows a representative time and temperature cycle according to the present invention. According to FIG. 1A, the material is cycled between about 2200° F. and about 2275° F. with holding periods at each of the high and low temperatures. FIG. 1B shows a schematic representation of the variation in the gamma prime precipitate quantity occurring as a function of the temperature cycle shown in FIG. 1A. The decrease in gamma prime quantity manifests itself both as a reduction in the number of precipitate particles present and in a reduction in size of the precipitate particles. FIG. 1C is a speculative schematic representation of the change in the gamma prime particle density as a function of temperature. FIG. 1C again relates to the cycle shown in FIG. 1A. It can be seen that in going from point A to point B in FIG. 1A that the number of gamma prime particles per unit volume decreases and that in going from point B to point C at the constant elevated temperature the reduction process may continue to a minor extent. In going from point C to point D, a decrease in temperature, the gamma prime particle density increases as the particles reprecipitate. However the density of particles at point D will probably be slightly less than at point A due to the preferential growth of particles which were not dissolved in preference to the nucleation of new particles. As the cycles continue, the number density of gamma prime particle will probably decrease. The cyclic changes in gamma prime morphology permit limited dislocation motion, and the reduction in overall dislocation energy without recrystallization. FIG. 1A shows two cycles; in practice however the cycle is repeated at least three times, preferably at least five times, and most preferably at least about ten times. The cycle would conventionally be started at point A although there is no reason why the cycle could not be started at points B, C or D or any point between so long as the requisite number of complete cycles are performed.

Now with respect to a more general description of the invention, one not limited to a specific composition, the high temperature portions, B-C and F-G, must be below the gamma prime solvus temperature but will be within about 100° F. and preferably within about 50° F. of the gamma prime solvus temperature. Prudence dictates that the temperature not be too close to the gamma prime solvus temperature since material composition variations will result in gamma prime solvus temperature variations and furnace conditions are usually not controllable to better than about ±10° F. The lower temperature should be more than about 50° F. below the upper temperature. The time at which the material is held at the different temperatures will generally range from about ten minutes to about two hours although there will be no detriment incurred by increasing this time.

The elevated temperature can also be defined as a temperature at which the majority (e.g. more than 80%) of the gamma prime solvus material is in solid solution but sufficient gamma prime material remains in precipitate form to prevent recrystallization. The lower temperature can be defined as a temperature at which most of the gamma prime material (e.g. more than 50%) is present in precipitate form. The heating and cooling rates and the time of holding at the upper and lower temperatures are selected so that the gamma prime solution and dissolution occurs at a controlled rate permitting substantial recovery processes to occur without recrystallization. The rate of heating and cooling and the time of holding at each temperature to achieve the desired result will be influenced by the superalloy composition. Superalloys which have relatively rapid kinetics of gamma prime phase solution and precipitation can be heated at a higher rate and held at temperature for shorter periods of time than would be required for materials with slower gamma prime kinetics.

It will also be appreciated that changing the rate of heating and cooling and the times at which the material is held at the upper and lower temperatures will substantially change the total cycle time and it is entirely within the skill of the skilled artisan to determine the optimum parameters for the particular superalloy in question. For example, if one elected to perform a process shown in FIG. 1A using heating and cooling rates of 1° F. per minute and holding times of thirty minutes, the total cycle time would be 210 minutes. Alternatively, if one elected to use heating and cooling rates of 5° F. per minute and holding times. of only ten minutes, the total cycle time would be 55 minutes meaning that approximately four of the latter cycles could be performed in the time required to perform one of the earlier described cycles. The choice of whether to perform few cycles using slow cooling rates and long times at temperature or more cycles at higher heating and cooling rates and shorter times at temperature is entirely within the purview of the artisan.

It has previously been mentioned that the cycle could be started at any time at any point in the cycle without adverse effects. It should also be observed that although the cycle shown in FIG. 1 is symmetrical and that the heating and cooling rates are identical and the holding times at upper and lower temperatures are identical, one performing the invention with regard to a particular alloy may well find that the optimum heating and cooling rates are not necessarily identical and that the holding times are not likewise necessarily identical in order to achieve a desired result in the shortest period of time. FIGS. 2–6 illustrate alternate cycles. The invention will be better understood through reference to the following illustrative example.

EXAMPLE

Single crystal samples having a nominal composition of 8.9% Cr, 6.8% Al, 9.7% W, 3.0% Ta, 1.0% Mo, 0.15% Hf, 0.1% Y, balance Ni were employed in this example. It was found that deformation of as little as 2% performed at low temperatures was sufficient to cause recrystallization of the single crystal articles upon exposure at temperatures above the gamma prime solvus (2320° F.). The following heat treatment cycle was employed—a low temperature of 2200° F., an elevated temperature of 2275° F., heating and cooling rates of about 1° F. per minute and holding times at upper and lower temperatures of 30 minutes (this is the cycle shown in FIG. 1). Experimentation revealed that while in the absence of the invention heat treatment, recrystallization occurred in this situation after a 2% deformation, use of the heat treatment (10 cycles as shown in FIG. 1 with heating and cooling at about 1° F. per minute) eliminated recrystallization except for deformations in excess of about 5%. Since the deformation which occurs during many processing steps which can be applied to superalloys (deformation bonding, machining, etc.) can be on the order of 2–5%, the invention heat treatment can serve as an effective means of eliminating recrystallization in single crystal articles after such normal processing steps.

Referring now to FIGS. 2–6, these figures all show, in schematic form, cyclic heat treatments which fall within the scope of the present invention. In all cases the figures are analogous to FIG. 1A in that the vertical axis represents temperature and horizontal axis represents time. In all cases the temperatures are within the previously defined ranges, i.e., within 100° and preferably within 50° F. of the gamma prime solvus for the higher temperature and the lower temperatures are at least 50° F. below the higher temperatures.

Figure 2:
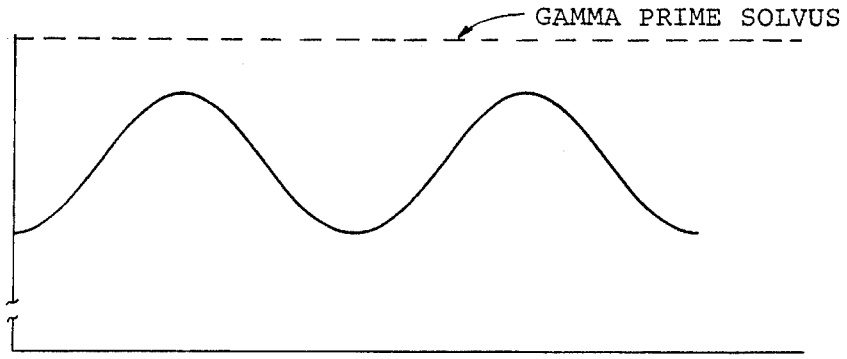
FIGS. 2–6 are schematic representations of alternate time-temperature cycles.
Figure 3:
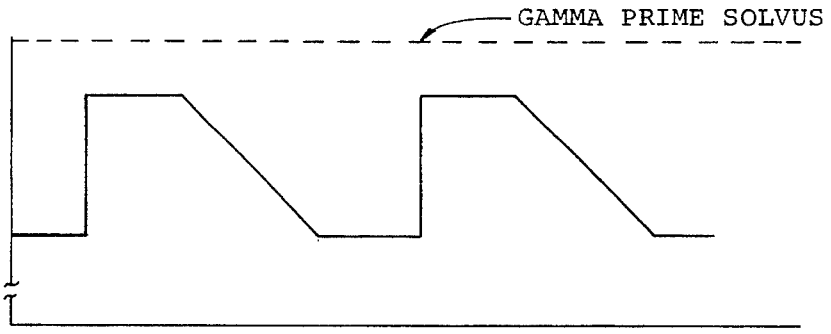
Figure 4:
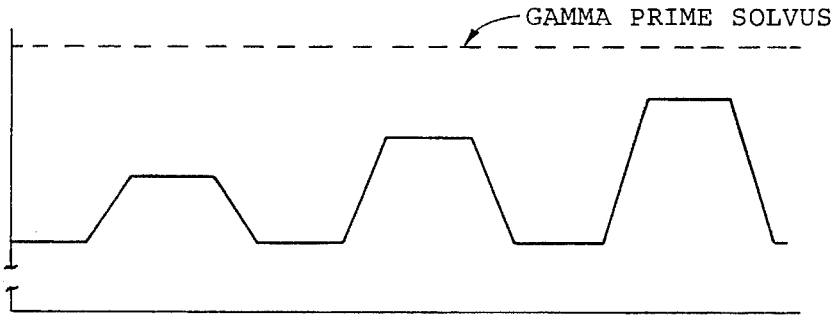
Figure 5:
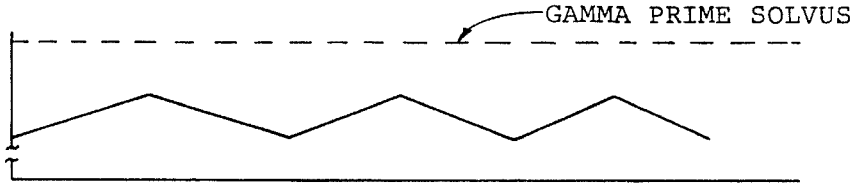
Figure 6:
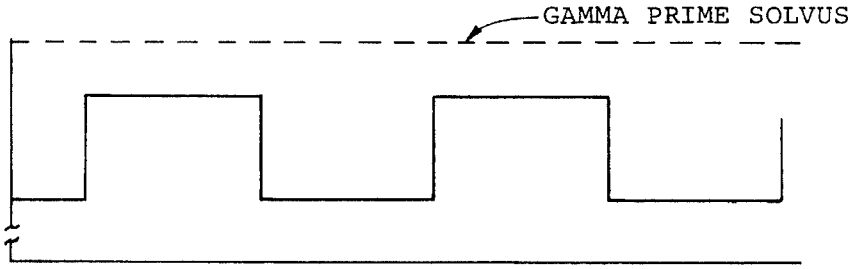

Referring to FIG. 2, this figure illustrates that the temperature cycle can be continuous in nature, i.e., the sine wave shown, rather than having distinct isothermal holding periods, so long as the period spent in the higher temperature range and in the lower temperature range is sufficient to achieve the desired results (preferably these times will range from 10 minutes to 10 hours). FIG. 3 illustrates that the cycle need not be symmetric, e.g. the heating rate may be greater than the cooling rate. FIG. 4 illustrates that the temperatures may change from one cycle to the next; in FIG. 4 the upper temperature increases from one cycle to the next. FIG. 5 illustrates the use of slow heat-up and cooling rates and the elimination of isothermal holding periods. Again the time spent in the upper and lower temperature ranges must be sufficient to accomplish the desired result. FIG. 5 also illustrates another potential variation on the theme in that the cycle time need not be constant from one cycle to the next. In FIG. 5 the cycle time is shown to be decreasing with the increasing cycles. Finally, FIG. 6 illustrates the use of abrupt heating and cooling rates. As shown in FIG. 6 the resultant temperature cycle is almost that of a square wave. It is clearly within the abilities of those skilled in the art to desire a cyclic heat treatment appropriate for their purposes including any and all features described in these figures.

It should be understood that the invention is not limited to the particular embodiments shown and described herein, but that various changes and modifications may be made without departing from the spirit and scope of this novel concept as defined by the following claims.

I claim:

1. A method for reducing the tendency of deformed gamma prime strengthened superalloy articles to recrystallize which comprises at least three cycles of alternating temperature wherein a single cycle comprises an exposure at a first temperature at which the majority of the gamma prime phase is in solid solution, but sufficient gamma prime remains out of solution to prevent recrystallization and an exposure at a second, lower temperature at which most of the gamma prime phase is present in precipitate form, said first temperature being below but within 100° F. of the gamma prime solvus.

2. A method as in claim 1 in which at least five cycles are performed.

3. A method as in claim 1 in which at least ten cycles are performed.

4. A method as in claim 1 in which said first temperature at which the majority of the gamma prime is in solid solution is within 50° F. of the gamma prime solvus.

5. A method as in claim 1 in which said temperature at which most of the gamma prime phase is present in precipitate form is at least 50° F. below said temperature at which the majority of the gamma prime phase is in solid solution.

6. A method for reducing the tendency of moderately deformed nickel base superalloy single crystals to recrystallize when heated to temperatures in excess of their gamma prime solvus temperature, said heat treatment comprising:

at least three cycles of alternating temperature wherein a single cycle comprises an exposure at a first temperature at which the majority of the gamma prime phase is in solid solution, but sufficient gamma prime remains in precipitate form to prevent recrystallization, and an exposure at a second, lower temperature at which most of the gamma prime phase is present in precipitate form, said first temperature being below but within 100° F. of the gamma prime solvus temperature.

7. A method as in claim 6 in which at least five cycles are performed.

8. A method as in claim 6 in which at least ten cycles are performed.

9. A method as in claim 6 in which said temperature at which most of the gamma prime phase is present in precipitate form is at least 50° F. below said temperature at which the majority of the gamma prime phase is in solid solution.

10. A method for reducing the tendency of moderately deformed nickel base superalloy single crystal articles to recrystallize, said articles exhibiting a gamma prime solvus temperature, which comprises at least three cycles of an alternating temperature exposure wherein a single cycle comprises an exposure at a first temperature below but within about 100° F. of the gamma prime solvus and an exposure at a second temperature at least about 50° F. below the first temperature, whereby the tendency of the moderately deformed single crystal to recrystallize upon exposure to temperatures in excess of the gamma prime solvus temperature will be reduced.

11. A method as in claim 10 in which at least five cycles are performed.

12. A method as in claim 10 in which at least ten cycles are performed.

13. A method as in claim 10 in which said first temperature is within about 50° F. of the gamma prime solvus.

* * * * *